United States Patent [19]

Walter et al.

[11] Patent Number: 4,483,176

[45] Date of Patent: Nov. 20, 1984

[54] ASSEMBLY HEAD FOR ASSEMBLING DOMED CAN ENDS WITH CAN BODIES

[75] Inventors: John Walter, Evergreen Park, Ill.; Charles S. Kubis, Weston, Conn.

[73] Assignee: The Continental Group, Inc., Stamford, Conn.

[21] Appl. No.: 317,643

[22] Filed: Nov. 2, 1981

[51] Int. Cl.[3] ..... B21D 37/00

[52] U.S. Cl. ..... 72/412; 72/470; 413/22

[58] Field of Search ..... 72/361, 370, 412, 470; 413/3, 27, 45, 70, 53, 22, 26; 53/342, 359

[56] References Cited

U.S. PATENT DOCUMENTS 1,446,590 2/1923 Small ..... 413/3

4,148,269 4/1979 Leuese ..... 413/22

FOREIGN PATENT DOCUMENTS 56-36351 4/1981 Japan ..... 413/22

*Primary Examiner*—Leon Gilden

*Attorney, Agent, or Firm*—Charles E. Brown

[57] ABSTRACT

This relates to the assembling of a can end with a can body wherein there is an interference fit between the can end and the can body. There is provided an assembly head which receives in centered relation the can end and squares the can end with respect to its axis and where necessary reforms the peripheral portion of the can end. The can to be assembled with respect to the can end has an upper portion thereof entering into a lower guide portion of the assembly head both to align the can body with the can end and to reform the can body should it be out of round. Telescoping may then be automatically effected between the can end the the can body to complete the assembly. This abstract forms no part of the specification of this application and is not to be construed as limiting the claims of the application.

15 Claims, 4 Drawing Figures

ASSEMBLY HEAD FOR ASSEMBLING DOMED CAN ENDS WITH CAN BODIES

This invention relates in general to new and useful improvements in can manufacture, and more particularly to the assembling of a domed metal can end with a thin wall can body.

There has been recently developed a can construction wherein the body is formed of very thin aluminum having a wall thickness on the order of 0.004 inch and wherein there is assembled with that body a domed end with there being an interference fit between the can end and the body. This assembly must be on an automatic basis and at a very rapid rate.

It will be apparent that, because of the thinness of the body wall, the body wall will be slightly out of round, and therefore it must be trued before being assembled with a can end. The same is also true of the can end.

It is also to be understood that the can end must be absolutely square with respect to the axis of the can body or there will be great difficulties experienced in both applying the can end and the final positioning thereof with respect to the can body.

In accordance with this invention, there is provided an assembly head which is constructed to receive a domed can end in a manner wherein the centering of the can end, the reshaping of the can end and the squaring of the can end are all automatically assured. Further, the assembly head serves both as a guide for the can body and means for reshaping the can body so that its configuration matches that of the can end.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
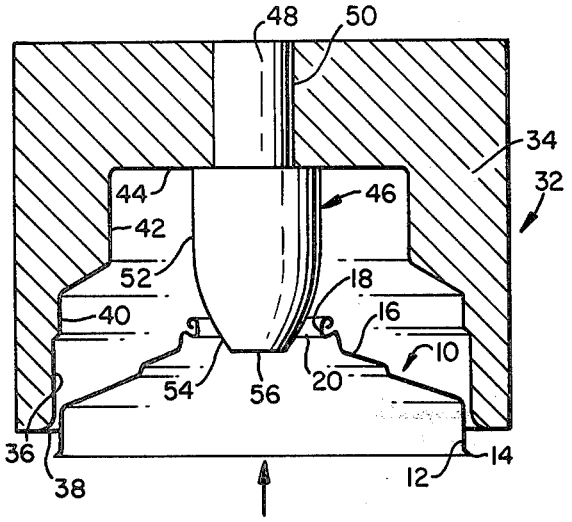
FIG. 1 is a schematic view through an assembly head showing a can end formed in accordance with this invention being initially engaged with respect to the assembly head.

Referring now to the drawings in detail, it will be seen that there is illustrated in FIG. 1 a domed can end 10 which is formed of metal and is preferably formed of aluminum having a wall thickness on the order of 0.009 inch. The can end 10 has a lower cylindrical portion 12 for telescoping over a free end of a can body, with the cylindrical portion 12 terminating in a slightly outturned flange or curl 14.

The can end 10 includes a domed intermediate portion 16 which terminates in an upwardly flared neck 18 which defines a central opening 20 in the can end 10.

Figure 2:
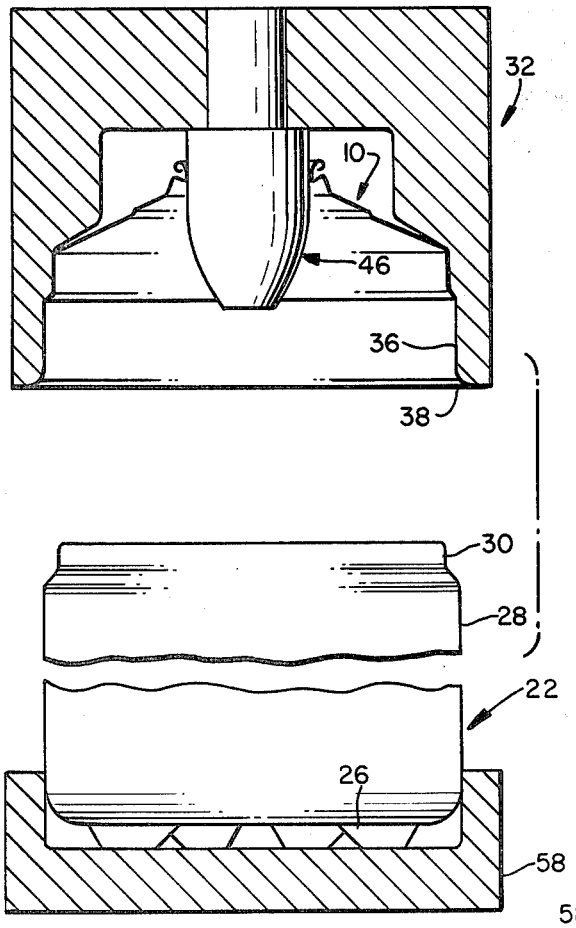
FIG. 2 shows the assembly head and can end in their fully telescoped relation and in position for initiating the application of the can end to a can body.
Figure 4:
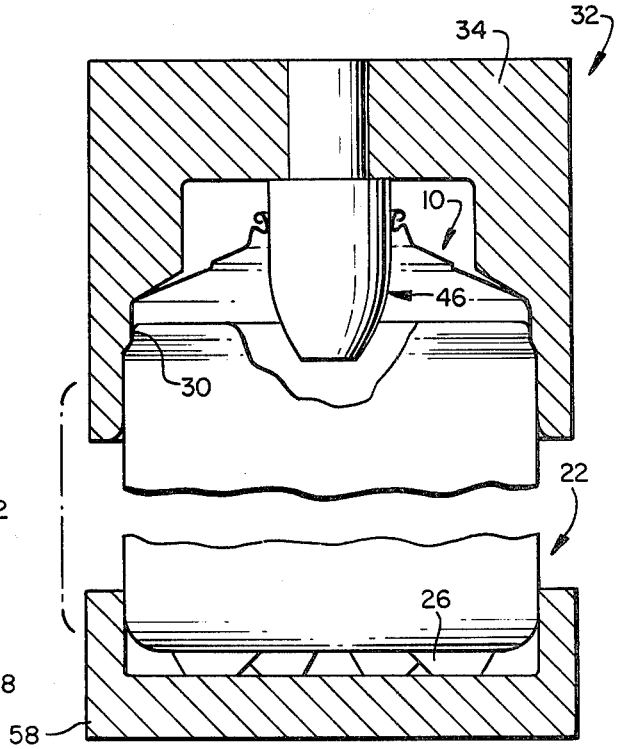
FIG. 4 is a sectional view similar to FIG. 3, and shows the can body telescoped within the can end in the final relative positions of the can body and the can end.

In FIG. 2 there is illustrated a typical can body to which the can end 10 is to be applied, the can body being identified by the numeral 22. The can body 22 is provided with an integral bottom 26 and has a cylindrical body 28. The upper end of the body 28 is open and has been necked in to define a necked-in terminal portion 30.

The external diameter of the body 28 corresponds substantially to the external diameter of the can end 10 at the flange 14, while the external diameter of the necked-in portion 30 is of a size to be forced within the cylindrical portion 12 of the can end 10.

As above stated, the wall thickness of the body 28 may be on the order of 0.004 inch and is thus very thin and not truly self-supporting without the closure 10 being applied.

In the application of the can end 10 to the can body 22, there is provided an assembly head, generally identified by the numeral 32. The assembly head is in the form of an inverted cup-shaped member 34 which has a lower cylindrical internal wall 36 which continues upwardly from a flared opening 38. The interior of the assembly head up above the cylindrical portion 36 is configurated to match the external shape of the can end 10 as at 40. The interior surface of the assembly head terminates in an upper cylindrical portion 42 which is closed by an upper end 44. A centering pin 46 is carried by the member 34 in centered relation to the cavity thereof and is secured to the member 34 by a mounting pin portion 48 which is received in a bore 50 opening through the end or top wall 44. The centering pin 46 includes a cylindrical portion 52 of a diameter corresponding to the diameter of the opening 20 of the can end 10. Below the cylindrical portion 52, the centering pin 46 tapers downwardly but with an arcuate cross section as at 54, and terminates in a square-cut end 56.

As will be apparent from FIG. 1, when there is a relative telescoping movement between the assembly head 32 and a can end 10, the can end 10 will automatically be initially centered by the centering pin 42 and then, as the can end 10 enters within the assembly head, the periphery of the can end will be guided first into the cylindrical portion 36. As the can end 10 moves further into the assembly head 32, the neck 18 will engage the centering pin 46 and be centered therein. Further upward movement of the can end 10 relative to the assembly head 32 will result in the engagement of the periphery of the lower part of the domed can end 10 with the wall portion 40 of the member 34 with the result that, should the lower part of the can end 10 be out of round, it will be reshaped. Further, the engagement between the can end and the wall portion 40 of the cup shaped member 34 will function as a stop to limit relative telescoping of the can end with the assembly head in a manner which will also assure that the can end 10 will be square with respect to the axis of the assembly head 32.

Although but a single assembly head 32 has been illustrated, it is to be understood that the can ends and a plurality of such assembly heads will move in unison with the can ends moving toward the assembly heads and being forced into telescoping relation with respect thereto.

Figure 3:
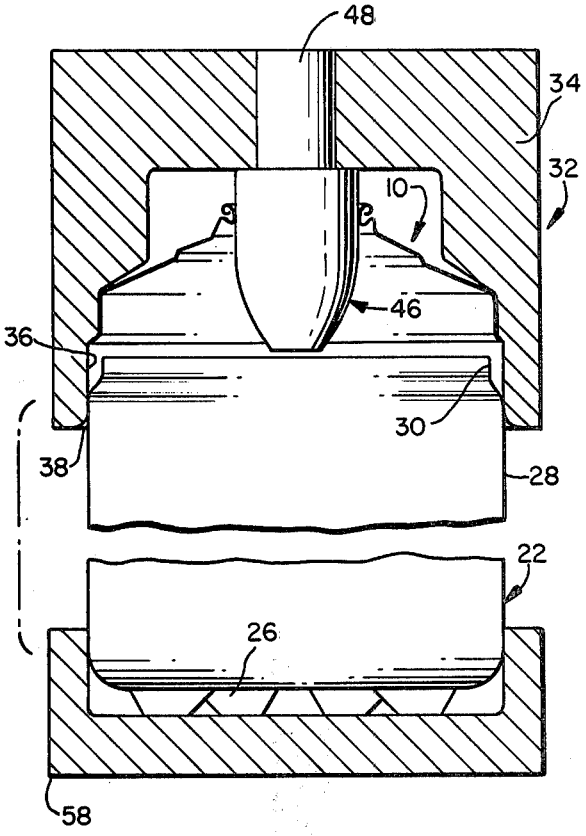
FIG. 3 is a sectional view similar to FIG. 2, and shows the can body having engaged the assembly head and being simultaneously reshaped and aligned with the can end.

After a can end 10 has been firmly seated within an assembly head 32, the assembly head 32 moves into overlying, vertically aligned relation with respect to a holder 58 which is also of a cup-shaped configuration and in which there is seated a lower part of the can 22. The assembly head 32 and the holder 58 move together with the necked-in portion 30 of the can 22 being lead into the tapered open mouth 38 of the assembly head 32 and then the upper part of the body 28 moves into the cylindrical lower portion 36 of the assembly head, as is shown in FIG. 3. The fit between the assembly head 32 and the upper part of the body 28 is such that should the upper part of the body 28 be out of square, it will reform the upper part of the body to make it cylindrical.

The body 28 is now in alignment with the lower part of the can end 10 and, as the holder 58 and the assembly head 32 move together, the necked-in body portion 30 is forced into the interior of the lower cylindrical portion 14 of the can end 10 so as to complete the assembly. The fit between the can end 10 and the can 22 is such that as the assembly head 32 and the holder 38 separate, the can end 10 will be retained on the can 22 and the two will remain assembled as a unit.

It is to be understood that if any assist is necessary, air under pressure could be directed into the upper part of the cavity within the assembly head 32 so as to force the can end out of the assembly head when the assembly head and the holder separate. It is also to be noted that it is feasible at this time to apply a vacuum within the same cavity so as to urge the can end 10 into the assembly head and to retain it in place, although normally the frictional engagement of the can end within the assembly head will be sufficient to retain the can end in place.

Although only a preferred embodiment of the assembly head and the mode of utilizing the same have been specifically illustrated and described herein, it is to be understood that minor modifications may be made in the assembly head without departing from the spirit and scope of the invention as defined by the appended claims.

What is claimed is:

1. An assembly head for assembling a domed can end on a can body wherein the can end has a central opening, said assembly head being generally in the form of a cup including a body and an end wall, said body having an internal peripheral shoulder axially spaced from said end wall and forming stop means for limiting movement of a can end into said assembly head, and centering pin means carried by said end wall and projecting into said body for assuring the centering of a can end in said body, said body axially beyond said stop means being of an enlarged cross section for forming means for receiving a tilted can end.

2. An assembly head according to claim 1 wherein said centering pin means includes a cylindrical base portion, and said centering pin means being tapered between said free end and said base portion whereby an initially tilted can end may be received on said centering pin means and moved into a seated squared portion within said assembly head.

3. An assembly head according to claim 1 wherein said body adjacent said internal shoulder is of an internal size and configuration to form means for both accurately positioning a can end therein and for reshaping a slightly out of round can end.

4. An assembly head according to claim 2 wherein said tapered portion of said centering pin means is rounded in axial section.

5. An assembly head according to claim 1 wherein said body extends beyond said stop means and is of a diameter to form means for guidedly receiving a can body to which a selected can end is to be applied.

6. An assembly head according to claim 1 wherein said centering pin means has a terminal free end located generally in transverse alignment with said stop means.

7. In a method of applying a domed can end to a can body in telescoped relation, the steps of providing a can end with a center opening, providing a cup-shaped assembly head having an internal diameter generally corresponding to the peripheral diameter of the can end, providing a centering pin in the assembly head, effecting relative telescoping of the can end and the centering pin to generally align the can end with the assembly head, and then continuing the telescoping with the periphery of the can end entering the assembly head.

8. A method according to claim 7 wherein the assembly head has a stop surface recessed therein intermediate inner and outer ends of said assembly head, and the can end is directed against the stop surface to automatically square the can end relative to an axis of the assembly head.

9. A method according to claim 8 wherein the assembly head is utilized to reshape an out of round can end.

10. A method according to claim 7 wherein the assembly head is utilized to reshape an out of round can end.

11. A method according to claim 8 wherein there is provided a can having a body terminating in an open end defined by a terminal necked-in portion and wherein the external diameter of the can body corresponding to the internal diameter of the assembly head, and using the assembly head as a guide guiding the necked-in end of the can body into the can end in telescoped relation.

12. A method according to claim 11 wherein a can having an out of round body adjacent the necked-in portion thereof is reshaped by the assembly head before the necked-in portion of the can enters the can end.

13. A method according to claim 7 wherein there is provided a can having a body terminating in an open end defined by a terminal necked-in portion and wherein the external diameter of the can body corresponding to the internal diameter of the assembly head, and using the assembly head as a guide guiding the necked-in end of the can body into the can end in telescoped relation.

14. A method according to claim 13 wherein a can having an out of round body adjacent the necked-in portion thereof is reshaped by the assembly head before the necked-in portion of the can enters the can end.

15. A method according to claim 7 wherein the periphery of the can end fully enters the assembly head.

* * * * *